United States Patent [19]

Masuda et al.

[11] 4,381,325

[45] Apr. 26, 1983

[54] LIQUID RETAINING SYNTHETIC FIBER, PROCESS FOR PRODUCING THE SAME, AND PRODUCTS

[75] Inventors: Yutaka Masuda, Otsu; Yoshiteru Kiyomura, Shiga; Koichi Nishizakura, Otsu, all of Japan

[73] Assignee: Toray Industries, Inc., Tokyo, Japan

[21] Appl. No.: 185,160

[22] Filed: Sep. 8, 1980

[30] Foreign Application Priority Data

Sep. 10, 1979 [JP] Japan ..... 54-115171
Sep. 12, 1979 [JP] Japan ..... 54-116622

[51] Int. Cl.[3] ..... D02G 3/00; D06M 5/02; A46B 15/00

[52] U.S. Cl. ..... 428/91; 8/115.5; 15/159 A; 15/DIG. 5; 428/397; 428/399; 428/400

[58] Field of Search ..... 428/397, 399, 400, 91, 428/159 A, DIG. 5; 8/115.5

[56] References Cited

U.S. PATENT DOCUMENTS

| | | | |
|---|---|---|---|
| 2,207,156 | 7/1940 | Neville et al. | 428/399 |
| 2,207,157 | 7/1940 | Neville et al. | 428/399 |
| 2,370,112 | 2/1945 | Truitt | 428/399 |
| 2,520,502 | 8/1950 | Haux | 428/400 |
| 2,666,976 | 1/1954 | Olmer et al. | 428/399 |
| 2,737,702 | 3/1956 | Schmidt et al. | 428/92 |
| 2,923,598 | 2/1960 | Reis et al. | 15/159 R |
| 3,251,729 | 5/1966 | Shaw | 428/399 |
| 3,344,457 | 10/1967 | Grobert . | |
| 3,422,180 | 1/1969 | Hanson et al. . | |
| 3,706,111 | 12/1972 | Curtin | 15/159 A |
| 4,285,892 | 8/1981 | Betsuda et al. | 15/159 A |

FOREIGN PATENT DOCUMENTS

| | | | |
|---|---|---|---|
| 49-47618 | 5/1974 | Japan | 428/399 |
| 52-105070 | 9/1977 | Japan . | |
| 955778 | 4/1964 | United Kingdom | 15/159 A |

*Primary Examiner*—Mary F. Downey
*Attorney, Agent, or Firm*—Austin R. Miller

[57] ABSTRACT

This invention relates to a liquid-retaining synthetic fiber having a substantially pointed free end and including a tapered portion having an acute ridgeline on its surface. It is prepared from a synthetic fiber having in section at least one concave portion and at least one convex portion which gradually taper off toward the outside from the center.

These fibers are suitable for use in brushes, or for the manufacture of knitted or woven fabrics or flocked fabrics having an animal hair-like or fur-like touch or appearance.

15 Claims, 25 Drawing Figures

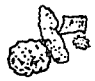
FIG. 7a
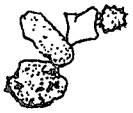
FIG. 7b
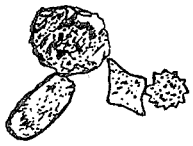
FIG. 7c
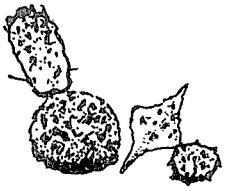
FIG. 7d
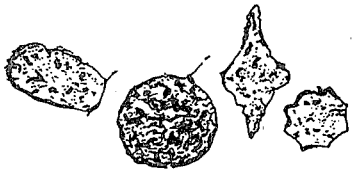
FIG. 7e
FIG. 7f
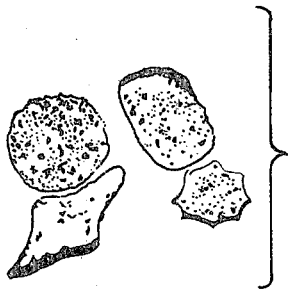
FIG. 7g
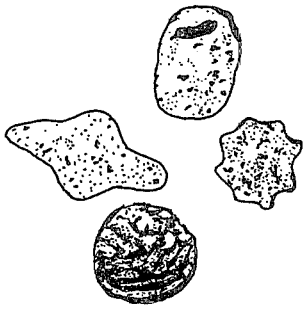
FIG. 7h
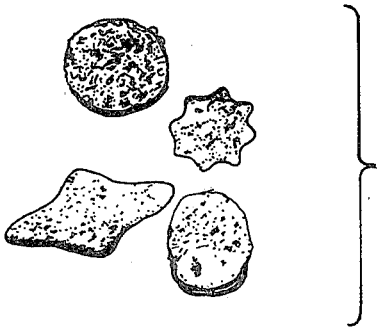
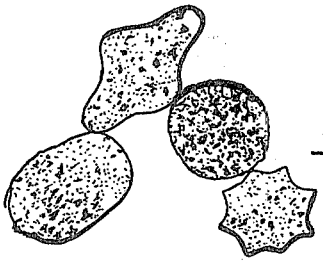
FIG. 7i
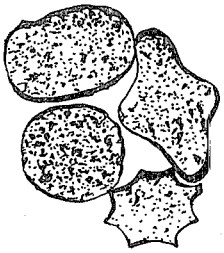
FIG. 7j

LIQUID RETAINING SYNTHETIC FIBER, PROCESS FOR PRODUCING THE SAME, AND PRODUCTS

The present invention relates to a novel liquid-retaining tapered synthetic fiber, to a process for producing the same, and to brushes, fabrics and other products made from such fibers.

BACKGROUND OF THE INVENTION

Animal hairs having so-called tapered or sharpened ends are now used in various fields and articles, including brushes such as writing brushes and painting brushes made from hairs of weasels, raccoons and the like. Further, hairs such as those from Angora rabbits and the like have been mix-spun and incorporated into knitted or woven fabrics. Another well known use is in furs such as mink, fox, and the like.

These animal hairs, however, are very expensive, and extensive efforts have been made to produce synthetic fibers having their desirable characteristics have heretofore been proposed.

Means have been described for obtaining relatively good sharpened ends in synthetic fibers, as disclosed for example, in Japanese Patent Publication No. 40195/75 and in our Japanese Patent Application No. 105070/77, in which hydrolyzability of polyesters is utilized. Sufficient durability is obtained when tapered fibers so produced are used for writing brushes, painting brushes or the like, but these brushes are inferior to brushes of animal hairs as regards their ability to retain liquids. Accordingly, their characteristics and the ease of brush handling leave room for improvement.

Surprisingly, we have now found that when a fiber has a very special cross-sectional shape, the foregoing defects are eliminated and good brushes may be provided which are very suitable for writing and painting.

Furthermore, the fiber according to the present invention is excellent as compared to conventional fibers for formation into knitted or woven fabrics resembling those having animal hairs such as those of the Angora rabbit. Further, these fibers may be made into fabrics having a fur-like touch. Furthermore, it has now been found that fibers according to the present invention themselves have good touch and appearance.

Fibers according to the present invention are tapered or sharpened synthetic fibers each having a substantially pointed free end and including a tapered portion having an acute ridgeline extending longitudinally along the fiber surface.

The process for preparing animal hair-like synthetic fibers according to this invention includes the steps of subjecting at least one end of a bundle-like assembly of synthetic fibers to a decomposing or dissolving treatment in a treating solution to obtain fibers having tapered or sharpened ends. The fibers used in the process are characterized in that their cross-sections include at least one concave portion and at least one convex portion, which portions gradually taper off toward the outside from the center when viewed in cross section.

Fibers of this invention may be made into brushes comprising sharpened synthetic fibers having substantially pointed free ends, the fibers including tapered portions having a sharp or acutely curved ridgeline extending longitudinally along the body portion of the fiber, preferably to its tapered end.

Fabrics may be made which have naps of sharpened synthetic fibers having substantially pointed tip ends and including tapered portions having acute ridgelines as heretofore described.

According to the present invention fibers having long tapered or sharpened end portions and good liquid-retaining properties are very suitable for brushes or for the manufacture of knitted or woven fabrics or flocked fabrics having an animal hair-like or fur-like touch or appearance.

When fur-like fibrous structures are prepared from fibers of the present invention according to known techniques such as electrostatic flocking or sliver knitting, the fibers of the present invention have excellent fiber separability over conventional sharpened synthetic fibers having circular or flat cross-sections. This not only facilitates passage of the fibers through the processing steps, but also remarkably improves the appearance, luster and touch of the product.

The fibers of the present invention can be used in all fields where animal hairs have heretofore been used.

Specific embodiments of fibers according to the present invention will now be described with reference to the accompanying drawings. In the description which follows specific terms will be used for purposes of clarity, but these are not intended to define or to limit the scope of the invention, which is defined in the claims.

IN THE DRAWINGS

In FIG. 1, the radial direction is magnified several times as compared to the axial direction in order to accentuate features to be described herein.

FIGS. 7*a* through 7*j* represent successive sectional views of a group of dissimilar fibers, such sections having been taken at 400μ (7*a*), 600μ (7*b*), 700μ (7*c*), 900μ (7*d*), 1 mm (7*e*), 1.5 mm (7*f*), 3 mm (7*g*), 5 mm (7*h*), 7 mm (7*i*), 20 mm (7*j*), starting at the tips and proceeding toward the center.

Figure 8A:
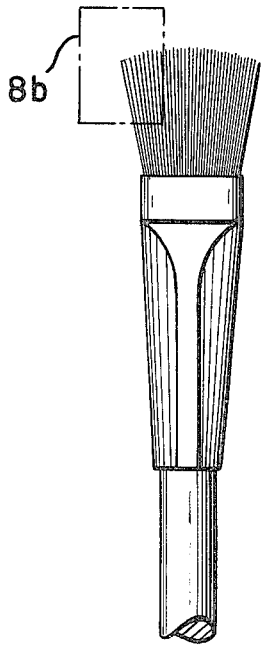
Figure 8B:
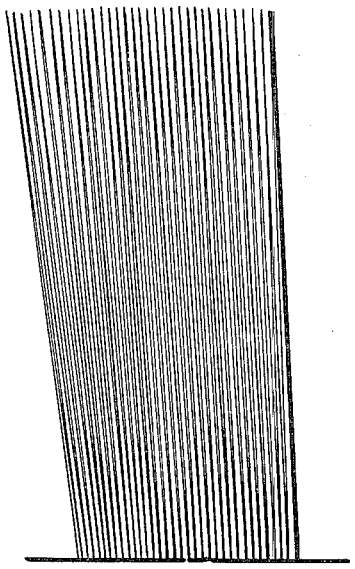

FIG. 8*a* shows a brush made of bristles of this invention and FIG. 8*b* shows a portion of the brush in enlarged form in order to reveal the tapered nature of the bristles.

Figure 9A:
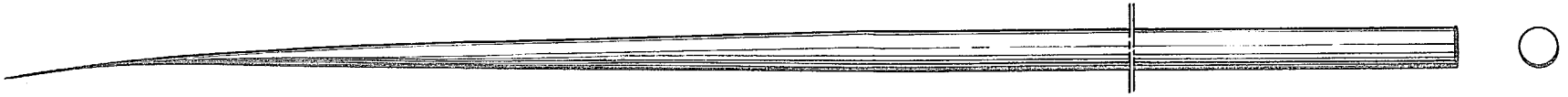
Figure 9B:
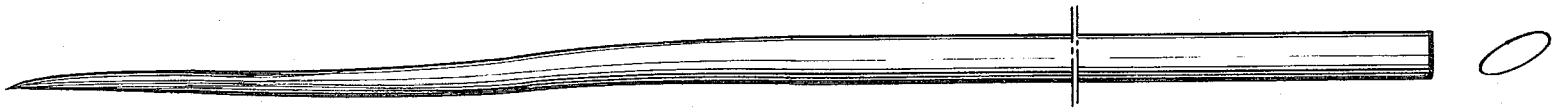
Figure 9C:
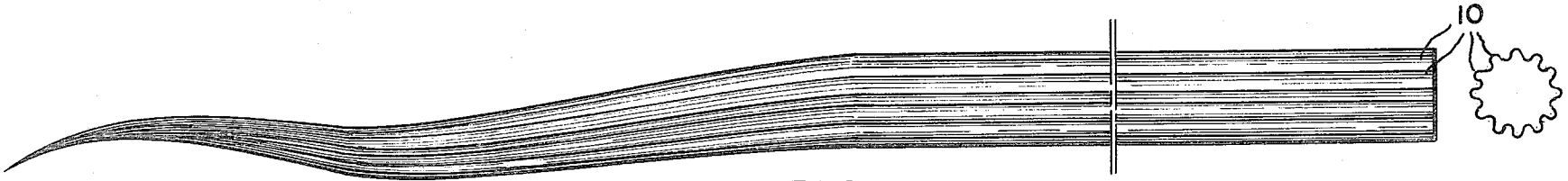

FIGS. 9*a* through 9*d* show various forms of bristles, highly enlarged, with cross-sectional shapes of each at the right-hand portion of the drawing. The forms shown in FIGS. 9*a* and 9*b* present difficulty and have disadvantages but those appearing in FIGS. 9*c* and 9*d* have ridgelines like those shown in FIG. 2 or FIG. 3 and are excellent examples of fibers according to this invention.

Figure 6:
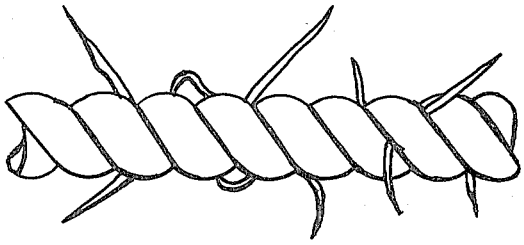
FIG. 6 shows a yarn spun from the fibers of this invention.
Figure 10:
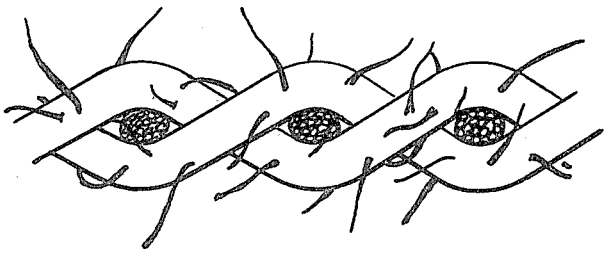

FIG. 10 shows a section of fabric made up of the mix-spun yarn of FIG. 6.

Figure 1:
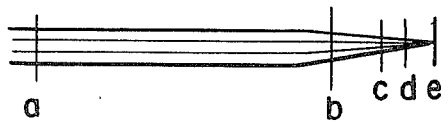
FIG. 1 is a side view schematically showing an end portion of a fiber embodying features of this invention.
Figure 12:
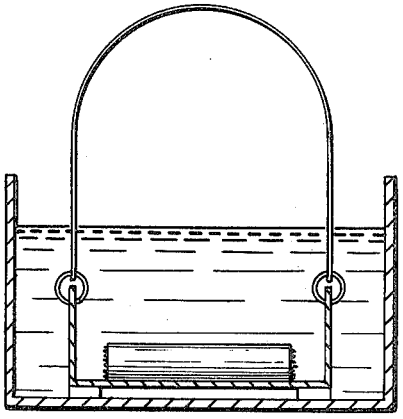
Figure 11:
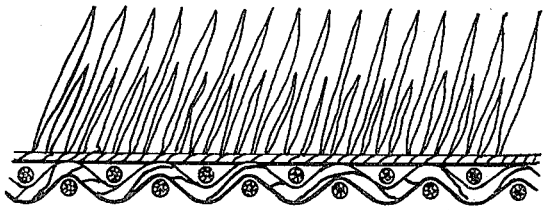
Figure 9D:
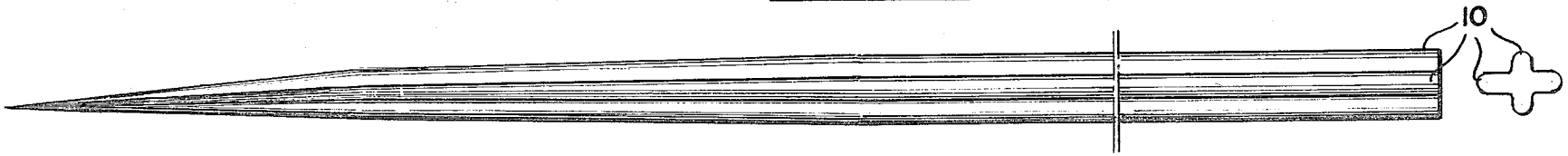

FIG. 11 shows a fabric having a woven base and electrostatically deposited cut flock adhered thereto, the flock being made by flock cutting tapered fibers of FIGS. 1, 9*d* or 9*e* for example; and FIG. 12 schematically shows a method of sharpening fibers.

DESCRIPTION OF INVENTION

Figure 2:
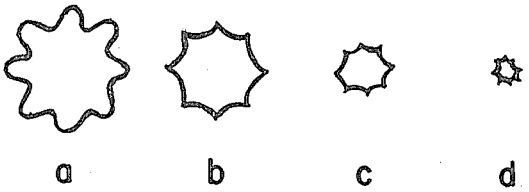
FIG. 2 shows cross sections of the fiber of FIG. 1, taken at various points along its length, as indicated at points a, b, c and d in FIG. 1.

Referring to FIGS. 1 and 2, the central portion of the fiber at a has an octafoliate section, and the tip end at e is substantially pointed. The tapered portion at b or at c or at d has eight acute ridgelines extending along its length substantially to the tip end.

We have now confirmed that fibers of the present invention create brushes that are excellent in comparison with brushes formed of conventional sharpened fibers without tapered portions having acute ridgelines thereon. A dramatic improvement is observed with respect to liquid-retaining properties, graphic characteristics and ease in handling. Furthermore, when fibers according to the present invention are used as synthetic hair or for making fur-like fabrics, a more delicate appearance and a dry touch, free of stickiness, can be obtained.

The fiber of the present invention has at least one acute ridgeline in the tapered portion, preferably about 2 to 20. A tapered or sharpened fiber having no acute ridgelines is very inferior to the fiber of the present invention in liquid-retaining properties and ease in handling when used in a brush. A fiber having more than 20 acute ridgelines is difficult to prepare on an industrial scale and less substantial improvement of the intended effects can be expected therefrom. In other words, if the number of acute ridgelines is increased beyond 20, the condition of the tapered portion is not substantially different from one having no acute ridgelines.

Figure 3:
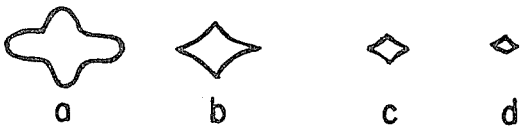
FIG. 3 represents a succession of sectional views similar to FIG. 2, of a fiber having a modified cross section.

In the tapered portion of the fiber of the present invention, a concave groove is present between every two adjacent ridgelines, and it is preferred that the depth of the concave groove be gradually decreased toward the tip end of the fiber. In this case, the expression "the depth" does not mean the absolute value of the depth but the depth relative to the diameter of the fiber. In other words, it is kept in mind that the shape of the section gradually changes along the length of the tapered portion, as shown in FIG. 2 or FIG. 3.

More specifically, although the depth of the concave groove in the section decreases as the groove proceeds toward the tip end, the concave groove is substantially present to a point extending very close to the tip end. As is seen from FIG. 2*d* or FIG. 7, the fiber may have an octafoliate section even very close to the tip end.

In accordance with the present invention, it is believed that the above mentioned ridgelines make important contributions to the graphic characteristics and other physical properties of the fiber and that the presence of the concave grooves improves the liquid-retaining properties of the fiber.

In the case where the tip end portion of the fiber does not have a shape as defined in the present invention, the tip end portion readily becomes fibrillated if the diameter of the tip end is reduced below a certain value. Such fiber is inferior in appearance, and when a brush is formed from such fiber, the tips are not arranged in good order and the brush is not suitable for writing. For example, in the case where the section of the tip end portion has a shape analogous to the shape of the section of the central portion but reduced in the size toward the tip end, the foregoing difficulties apply. We have experimentally confirmed that a sectional shape of this type is obtained when the fiber is partially heated and drawn.

In the practice of the present invention, the tip end of the fiber is substantially pointed. This means that it may be seen with the naked eye that the tip end has a point-like shape. More specifically, the diameter of the tip end portion is less than about 15%, preferably less than about 10%, of the diameter of the central portion, usually less than 10$\mu$.

Where in this specification reference is made to the "acute ridgeline", we mean a portion having a width which is less than about 10% of the diameter of the central portion of the fibers. A cross-section of an acute ridgeline may be referred to as an acute protrusion.

A novel process for the preparation of the sharpened or tapered fiber of the present invention will now be described. A synthetic fiber bundle containing fibers having specific sectional shapes may be treated with a chemical which is capable, with time, of decomposing or dissolving material of the fiber from the surface thereof. The preparation process is not limited to this process, which however is preferred in many instances. An example of such process is schematically shown in FIG. 12. In this case, both end tapered fibers are obtained.

We have by actual test runs confirmed that good results are obtained when the fibers have at least one convex portion in the section thereof, preferably a plurality of convex portions gradually reduced in size toward the outer side. It is especially preferred that a plurality of concave portions be present in the section of the fiber in addition to the above convex portions. In practicing the present invention, it is preferred to use a fiber having a deformation degree of about 1.1 to 5.0 in the section thereof, where deformation degree is defined as the ratio of the diameter of the circumcircle to the diameter of the inscribed circle. Examples of such sections having excellent degrees of deformation appear in FIGS. 2*a*, 3*a*, and 4*a* to 4*e*, inclusive.

Figure 5:
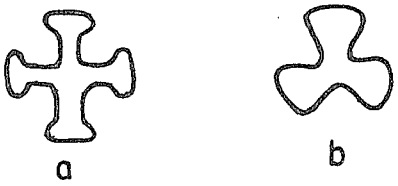
FIG. 5 represents two other cross-sectional fiber shapes with which difficulty is encountered in accordance with this invention.

On the other hand, it has been found that when a fiber has a deformation degree of less than about 1.1 or more than about 5.0, or has a convex portion with increased size toward the outside of the section, as shown in FIG. 5, a good sharp end cannot be obtained.

The fiber of the present invention can easily be obtained by gathering into a bundle a multiplicity of fibers having cross-sections as defined in accordance with this invention, cutting the bundle to an appropriate length, dipping the end portion of the fiber bundle into a hydrolyzing solution to a certain bundle depth and treating the end portion under hydrolyzing conditions. An alternative method comprises providing a monofilament bundle having a side face wrapped with a material having resistance to hydrolysis completely, dipping it into a hydrolyzing solution and treating under hydrolyzing conditions.

We have found that when a fiber having the specific sectional shape as shown in FIGS. 4*a* to 4*e* is used, the length of the sharpened end portion is increased. Surprisingly, the reason is unknown. It is believed, (but not known) that since diffusion of the decomposing liquid from the end face of the bundled fibers is enhanced, the region where the surface portions of fibers are removed by decomposition is caused to extend more to the interior of the fiber.

The fact that the sharpened or tapered end portion is much longer than in conventional products means that the animal hair-like touch or appearance can be further improved. More specifically, when the fibers are used and mix-spun for obtaining furs, brushes and synthetic hairs, the surface touch and appearance can be further improved. If conditions are appropriately established, the length of the sharpened or tapered end portion can be changed through a much broader range than in a process using a fiber of a circular cross-section.

The length of the sharpened or tapered end portion is influenced not only by the sectional shape of the material of the fiber but also by the conditions adopted for the decomposition treatment. According to the present invention, the length of the end portion can be increased beyond any level attainable by using a fiber having a circular section, when the same treatment conditions are adopted.

In the present invention, the size of the material fiber is not particularly critical, but in order to obtain animal hair-like products, it is preferred that the maximum fiber diameter be about 20 to 200μ in the material fiber.

The fiber length is not particularly critical; any optional length can be adopted.

Polyester fibers which may readily be hydrolyzed by surface treatment with an alkali at an appropriate concentration are preferably used in the present invention, although the entire range of applicable fibers is not so limited. For example, fibers of polyethylene terephthalate, polybutylene terephthalate and copolymers composed mainly thereof may be used.

Among polyesters, polybutylene terephthalate or its copolymer is most preferable for preparing animal hair-like sharpened or tapered fibers.

A fiber prepared by utilizing the surface hydrolyzability of the fiber material is characterized by acute ridgelines and arcuate concave portions that cannot be obtained according to ordinary fiber-forming methods. Furthermore, when alkali treatment is adopted, the fiber material surface is rendered hydrophilic by corrosion and fine convexities and concavities are imparted to the surface. It is considered that the presence of these fine convexities and concavities contributes to attainment of special characteristics in the fiber of the present invention.

FIGS. *7a* through *7j* show actual cross-sectional shapes of fibers treated concurrently by the same treatment, showing the manner in which cross-section changes along the lengths of the fibers. FIG. *7j* is a section taken at the mid-point of the bundle, and shows (roughly from top to bottom) oval, cruciform, circular and octafoliate shaped fibers. The cruciform and octafoliate shapes persist well out toward the tips of the fibers (FIGS. *7b* and *7a*), and provide an acute ridgeline which is an important feature of this invention.

As regards the configuration of the fiber of the present invention, it is preferred that the sharpened portion be free of crimps or bends especially when used as bristles for a brush, and be approximately symmetrical both lengthwise and in section. It is also preferred that the fiber be sharpened or tapered so that when viewing the surface of the fiber, the fiber bulges to some extent beyond an imaginary line connecting the tip end of the fiber and the point where sharpening or tapering begins (point "b" in FIG. 1, for example).

The fiber according to the present invention has excellent durability against rubbing or worm-eating and is easy to modify or to keep uniform as to quality.

When the sectional shape, size and the like factors are appropriately selected in the above-mentioned ranges, the following effects and advantages can be attained according to the present invention:

(1) When fibers of the present invention are used in brushes, a brush having a good shape and configuration is obtained and liquid-retention and durability are improved since the length of the sharpened end portion is very great.

(2) When fibers of the present invention are used for fabrics having a touch or appearance of an animal hair mix-spun fabric or fur, they are desirably uncrimped and made into a yarn such that appearing in FIG. 6 to form a fabric as shown in FIG. 10. They can be crimped also, if necessary. Alternatively, the fibers may be needle-punched into a base fabric and raised to form a fur-like fabric, or flock-cut and electrostatically flocked to form a flocked fabric as shown in FIG. 11. The appearance and touch of the products are highly improved, since the length of the sharpened end portion is great. Furthermore, since the fiber section includes useful convexities, separability is improved and passage of the fibers through the processing steps is remarkably facilitated. As examples, fiber separability during a spinning step or an electrostatic flocking step can be enhanced. Accordingly, products having a high quality, dry touch, which is free of stickiness, and gentle luster can be obtained.

The present invention will now be described with reference to the following Examples, which are not intended to define or to limit the scope of the invention:

EXAMPLE 1

Polybutylene terephthalate fibers having an octafoliate section as shown in FIG. *2a* (maximum diameter=90μ, deformation degree=1.4) were gathered into a bundle (bundle diameter=about 40 mm), and the bundle was cut to a length of 60 mm.

One end of the bundle was dipped along a length of 10 mm in a 40% by weight solution of sodium hydroxide maintained at 100° C. and treated for 90 minutes. The bundle was taken out from the treating solution, washed with water thoroughly and dried. The surface of the resulting sharpened fiber and the section of the sharpened portion as observed by a microscope are shown in FIGS. 1 and 2.

The length of the sharpened or tapered end portion was determined by the optical microscope observation and was found to be 8 mm.

In the fiber of the present invention, although the central portion had an octafoliate section, the tip end was substantially pointed and had a good sharpened or tapered shape. In the tapered portion, the fiber had eight acute surface ridgelines and eight arcuate intervening concave grooves. The octafoliate sectional shape was retained even to a point very close to the tip end. Furthermore, the depth of the concave groove in the section of the fiber was gradually reduced toward the tip end relative to the diameter of the fiber.

By using the resulting fiber, a model brush having a bundle diameter of about 8 mm was prepared, and the properties of the brush were examined with the use of India ink. The brush was highly improved over a brush formed by using a fiber obtained in Comparative Example 1 described hereinafter. More specifically, the amount of retained liquid was 2.1 times that of the comparative brush and the writing distance was 2.5 times that of the comparative brush. The comparative brush was defective in that a large quantity of ink flowed out and large drops of the ink were caused to drip. On the other hand, the brush of the present invention had no such defect and its graphic characteristics were very excellent.

The model brush was fixed with a paste and its graphic characteristics were examined while India ink was applied only to the tip. The comparative brush became scratchy immediately and written letters were blurred. On the other hand, in the case of the brush of the present invention, fine letters were written very easily and well.

COMPARATIVE EXAMPLE 1

A sharpening treatment was carried out in the same manner as described in Example 1, by using a polybutylene terephthalate fiber having the same diameter as in Example 1 but having a plain circular section. The surface of the resulting fiber resembled that of the fiber obtained in Example 1, but the section of the sharpened portion had a circular shape and the length of the sharpened end portion was found to be only 5 mm.

COMPARATIVE EXAMPLE 2

The same octafoliate polybutylene terephthalate fiber as used in Example 1 was applied to a blade heated at 180° C. and was drawn and cut to obtain a sharpened fiber. In the resulting fiber, the drawn portion was crimped, and the tip end portion was divided into at least two fibrils or was cut down unsharpened. A practically applicable brush could not be prepared from this fiber.

EXAMPLE 2

Polybutylene terephthalate fibers having a flat cruciform section as shown in FIG. 3*a* (large diameter portion=100μ, short diameter portion=60μ, deformation degree=2.5) were gathered into a bundle. The bundle was cut to a length of 70 mm and the side face was coated with polyamide film. The fiber bundle was completely dipped in a 30% solution of caustic soda maintained at 100° C. and was treated for 60 minutes.

After the treatment, the film was removed, and the treated bundle was washed with water thoroughly and dried. The weight of the resulting fiber was reduced by about 40% as compared to the original weight, and both ends of the fiber were sharpened. The sectional shape of the sharpened portion was as shown in FIGS. 3*b*, 3*c* and 3*d*. The tip end was substantially pointed. In the tapered portion, four acute ridgelines were formed on the surface and four concave grooves were present. The depth of each concave groove was found to have decreased toward the tip end relative to the diameter. The length of the sharpened end portion was found to be 7 mm.

A model brush was prepared by using the resulting fiber. The amount of retained liquid was 1.6 times that of the brush of Comparative Example 1, and the writing distance was 1.8 times that of Comparative Example 1. Thus, it is seen that the brush was highly improved.

This fiber was mix-spun with wool at the ratio shown below, and the mix-spun yarn was dyed and knitted to obtain a fabric having an Angora rabbit hair touch.

| | |
|---|---|
| Sharpened fiber: | 5% |
| Wool: | 95% |

The fabric had an excellent appearance and a good Angora rabbit hair touch.

EXAMPLE 3

Figure 4:
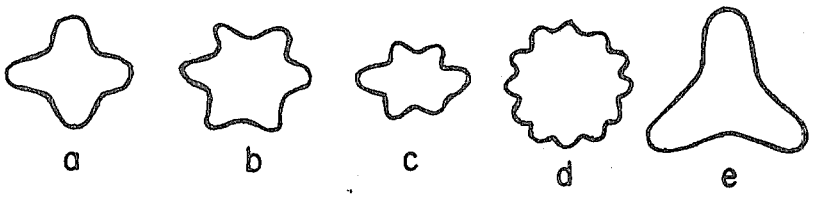
FIG. 4 represents a variety of cross-sectional fiber shapes applicable for producing sharpened synthetic fiber of this invention.

Polyethylene terephthalate fibers (100 denier) having a sectional shape as shown in FIG. 4*a* were gathered in a bundle, the face portion was wrapped with paper and the bundle was cut to a length of 100 mm. The fiber bundle was treated in a 30% solution of caustic soda at 100° C. for 50 minutes.

After treatment, the bundle was washed with water and dried to obtain a fiber bundle having both ends sharpened. Each tip end of the fiber was pointed, and the tapered portion had four acute ridgelines on the surface and four arcuate concave grooves. The length of sharpened end portion was found to be 7.5 mm. The fiber bundle was cut transversely at the center, and a model brush having a diameter of about 10 mm was prepared from the fibers of both halves. This brush was compared with a commercially available brush of animal hairs with respect to writing distance. The writing distance of the brush of the present invention was 1.1 times that of the commercially available brush of animal hairs. Accordingly, it was confirmed that the liquid-retaining property of the brush of the present invention is comparable to or superior to that of the animal hair brush.

EXAMPLE 4

The same flat cruciform polybutylene terephthalate fiber as described in Example 2 was cut to a length of 60 mm and sharpened in the same manner as described in Example 2. A sharpened fiber having an average length of 52 mm was obtained.

This fiber was mixed at a ratio shown below, passed through a roller card machine and a sliver was obtained having a thickness of 15 g/m.

| | |
|---|---|
| Sharpened fiber: | 50% |
| Modacryl fiber: (3d × 38 mm) | 50% |

A pile fabric was made by use of a sliver knitting machine. The ground yarn was two plied, acrylic yarn of 20 count and the fabric has a weight of 700 g/m$^2$.

After backing, the fabric was finished with a polisher.

The pile fabric, having sharpened guard hairs, had good feel and appearance.

EXAMPLE 5—COMPARATIVE EXAMPLE 3

The same polybutylene terephthalate fibers as described in Example 1 and Comparative Example 1, were gathered into bundles, respectively. The side surfaces of both bundles were wrapped with polyamide film, cut to a length of 20 mm, dipped completely in a 35% solution of caustic soda maintained at 110° C. and were treated for 30 minutes.

At both ends sharpened fibers having a length of 12 mm were obtained.

Both ends sharpened fibers were electrostatically flocked respectively on a polyester/rayon blend woven fabric previously coated with polyurethane as adhesive. Before flocking they were treated with a liquid containing colloidal silica, sodium silicate and a cationic antistatic agent for the purpose of enhancing ease of flocking.

The flocked fabric having sharpened fibers of octafoliate cross-section had a dry feel, was free from stickiness, and had a gentle luster and a much better appearance as compared to flocked fabric having sharpened fibers of circular cross-section.

EXAMPLE 6

Polybutylene terephthalate fibers having a flat cruciform section as shown in FIG. 3*a* (minimum diameter=20μ, maximum diameter=30μ, degree of deformation=2.0) were gathered into a bundle. The bundle was cut to a length of 70 mm and sharpened in the same manner as described in Example 2. A sharpened fiber having an average length of 62 mm was obtained. This fiber was mix-spun with wool and acrylic fiber at the ratio shown below.

| | |
|---|---|
| Sharpened fiber: | 35% |
| Acrylic fiber: (3d, 76 mm) | 25% |
| Wool: | 40% |

After dying, the mix-spun yarn of 16 count was knitted and raised. The raised fabric had an excellent feel and appearance like those of an angora rabbit down hair.

We claim:

1. A tapered synthetic fiber comprising an elongated body portion, a tapered portion terminating in a single point at its free end, said tapered portion having an acute ridgeline formed with neighboring arcuate concave grooves extending lengthwise along its tapered portion, said pointed free end having a diameter of less than about 15% of the diameter of the body portion.

2. A tapered synthetic fiber according to claim 1, wherein the fiber is a fiber of polyester series.

3. A tapered synthetic fiber according to claim 1, wherein the fiber is a fiber of polybutylene terephthalate series.

4. The fiber defined in claim 1 wherein the depth of each of said concave grooves gradually decreases relatively to the diameter of the fiber as said grooves progress toward said free end.

5. A tapered synthetic fiber according to claim 1 wherein said fiber has two tapered portions having pointed free ends.

6. A tapered synthetic fiber according to claim 1, wherein the acuteness of said ridgelines gradually increases toward the tapered portion from the body portion.

7. A tapered synthetic fiber according to claim 1, wherein said pointed free end has a diameter less than about 10% of the diameter of the body portion.

8. A tapered synthetic fiber according to claim 1, wherein said tapered portion has a plurality of said acute ridgelines.

9. A brush which comprises a plurality of tapered synthetic fibers, said tapered fiber comprising an elongated body portion, a tapered portion and a pointed free end, said tapered portion having an acute ridgeline formed with neighboring arcuate concave grooves extending lengthwise thereon, said pointed free end having a diameter of less than about 15% of the diameter of the body portion.

10. A fabric which has naps of tapered synthetic fibers, said tapered fiber comprising an elongated body portion, a tapered portion and a pointed free end, said tapered portion having an acute ridgeline formed with neighboring arcuate concave grooves extending lengthwise on its tapered portion, said pointed free end having a diameter of less than about 15% of the diameter of the body portion.

11. A fabric according to claim 10, wherein the fabric is a knitted, woven or raised fabric.

12. A fabric according to claim 10, wherein the fabric is a non-woven fabric.

13. A process for preparation of animal hair-like tapered synthetic fibers comprising forming polyester fibers into a bundle-like assembly and treating the fibers of the assembly with an alkali solution to produce fibers having a tapered free end, characterized in that said polyester fiber has in section at least one concave portion and at least one convex portion, whereby said tapered portion has an acute ridgeline formed with neighboring arcuate concave grooves extending lengthwise on its tapered portion, said convex portion when viewed in section gradually tapering off toward the outside from the center.

14. A process according to claim 13, wherein the polyester fibers are of the polybutylene terephthalate series.

15. A tapered synthetic fiber in the form of a monofilament having an elongated body portion and a tapered end portion terminating in a single point at its free end, means forming at least one acute ridgeline extending along the tapered portion, forming adjacent concave and convex portions in said tapered portion forming longitudinally extending capillary grooves for absorbtion of liquid along the length of said tapered portion, said grooves extending substantially to said single point at said free end.

* * * * *